US007776118B2

(12) United States Patent
Min et al.

(10) Patent No.: US 7,776,118 B2
(45) Date of Patent: Aug. 17, 2010

(54) CAP FOR HERMETICALLY SEALING RECEIVER DRIERS

(75) Inventors: Eunki Min, Daejeon-si (KR); Junil Jang, Daejeon-si (KR); Hyongnyol Kim, Daejeon-si (KR); Youngsung Lee, Daejeon-si (KR); Goangsik Min, Daejeon-si (KR); Seongkyun Byeon, Daejeon-si (KR); Junyoung Shin, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 780 days.

(21) Appl. No.: 11/658,715

(22) PCT Filed: Aug. 8, 2005

(86) PCT No.: PCT/KR2005/002569

§ 371 (c)(1),
(2), (4) Date: Jan. 29, 2007

(87) PCT Pub. No.: WO2006/016761

PCT Pub. Date: Feb. 16, 2006

(65) Prior Publication Data

US 2008/0314252 A1 Dec. 25, 2008

(30) Foreign Application Priority Data

Aug. 10, 2004 (KR) ..... 10-2004-0062860
Dec. 27, 2004 (KR) ..... 10-2004-0112724
Jul. 26, 2005 (KR) ..... 10-2005-0067750

(51) Int. Cl.
*B60H 1/32* (2006.01)
*F25B 39/04* (2006.01)
*F25B 43/00* (2006.01)

(52) U.S. Cl. ..... 55/385.1; 55/385.3; 55/385.4; 55/318; 55/502; 55/DIG. 17; 210/232; 210/452; 210/455

(58) Field of Classification Search ..... 55/385.1, 55/385.3, 385.4, 318, 502, DIG. 17; 210/232, 210/452, 455
See application file for complete search history.

(56) References Cited

U.S. PATENT DOCUMENTS 5,914,035 A * 6/1999 Bradford ..... 210/232

(Continued)

FOREIGN PATENT DOCUMENTS

EP 1 416 243 A1 5/2004

(Continued)

*Primary Examiner*—Duane Smith
*Assistant Examiner*—Minh-Chau T Pham
(74) *Attorney, Agent, or Firm*—Fulbright & Jaworski L.L.P.

(57) ABSTRACT

The present invention relates to a cap for hermetically sealing receiver driers, in which a cap body and a filter are separated and detachably engaged with each other and an O-ring is installed between the cap body and the filter, thereby facilitating the replacement of parts and the installation of the O-ring, favoring automatic assembly due to a tool insertion groove that can be formed long, achieving compactness of the cap due to the reduction of a total height of the cap when the cap body and the filter are engaged, improving a filtering effect by increasing the size of the filter with the cap being maintained in the same size, and facilitating engagement between the cap body and the filter and preventing the cap body from being released from a tank by discharging the air between the cap body and the filter.

9 Claims, 6 Drawing Sheets

U.S. PATENT DOCUMENTS

| | | | | |
|---|---|---|---|---|
| 6,299,661 | B1 * | 10/2001 | Bloomer | 55/385.3 |
| 6,757,933 | B2 * | 7/2004 | Oh et al. | 15/353 |
| 6,761,757 | B2 * | 7/2004 | Welker | 96/413 |
| 7,066,337 | B2 * | 6/2006 | Hsu | 210/452 |
| RE39,241 | E * | 8/2006 | Fosnight | 55/318 |
| 7,101,412 | B2 * | 9/2006 | Gossweiler | 55/502 |
| 7,604,128 | B2 * | 10/2009 | Dworatzek et al. | 210/455 |

FOREIGN PATENT DOCUMENTS

| | | |
|---|---|---|
| JP | 7032216 | 2/1995 |
| JP | 9324962 | 12/1997 |
| JP | 11257804 | 9/1999 |
| JP | 2000097525 | 4/2000 |
| JP | 2000-292030 | 10/2000 |
| JP | 2000320931 | 11/2000 |
| JP | 2001-033121 | 2/2001 |
| JP | 2001-41612 | 2/2001 |
| JP | 2001076806 | 3/2001 |
| JP | 2003-042601 | 2/2003 |
| JP | 2003090435 | 3/2003 |
| JP | 2003106713 | 4/2003 |
| KR | 10-2001 0065605 A | 7/2001 |
| KR | 10 2003 0030501 A | 4/2003 |
| KR | 10-20030086096 A | 11/2003 |
| KR | 10 2003 0093047 A | 12/2003 |

* cited by examiner

[Fig. 1]
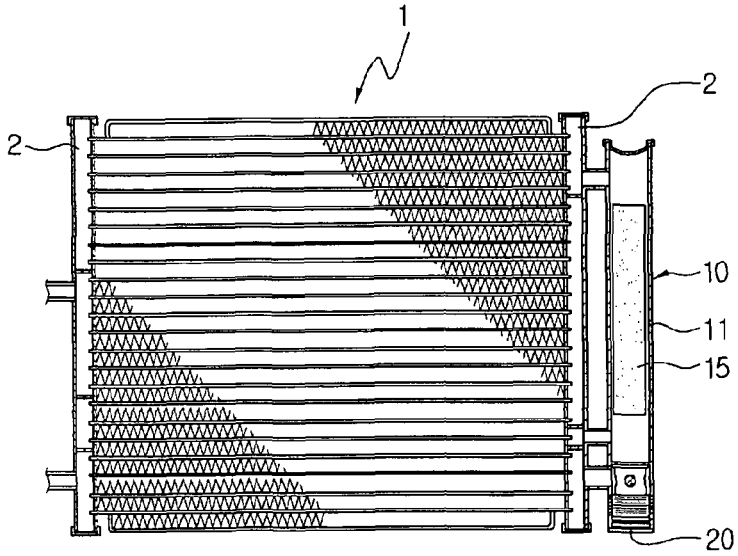
[Fig. 2]
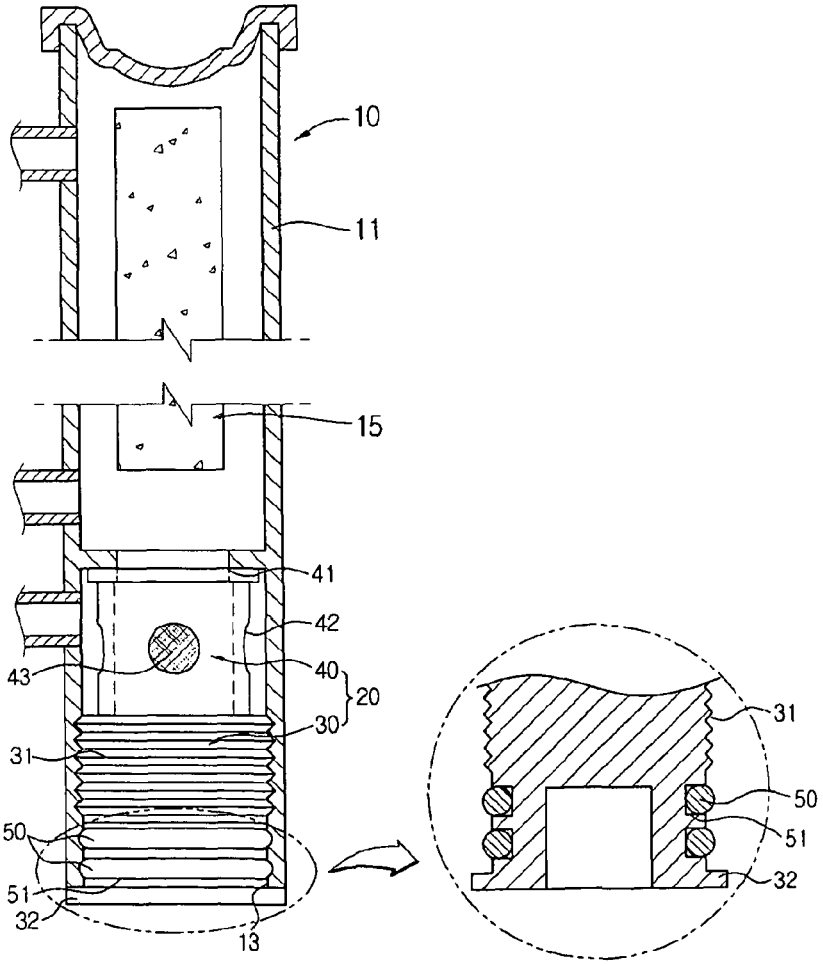

[Fig. 3]
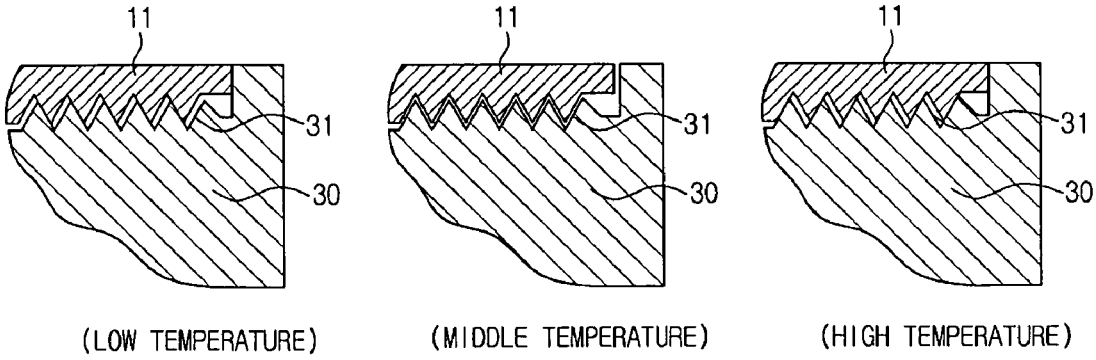
[Fig. 4]
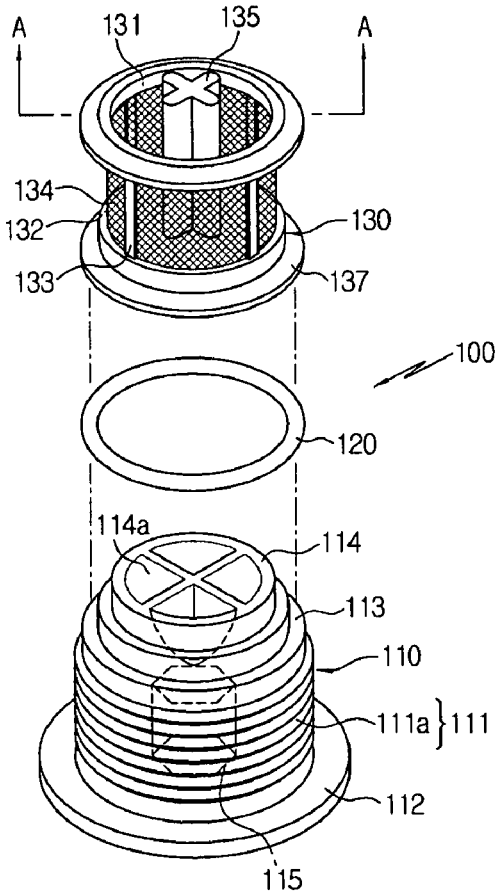

[Fig. 5]
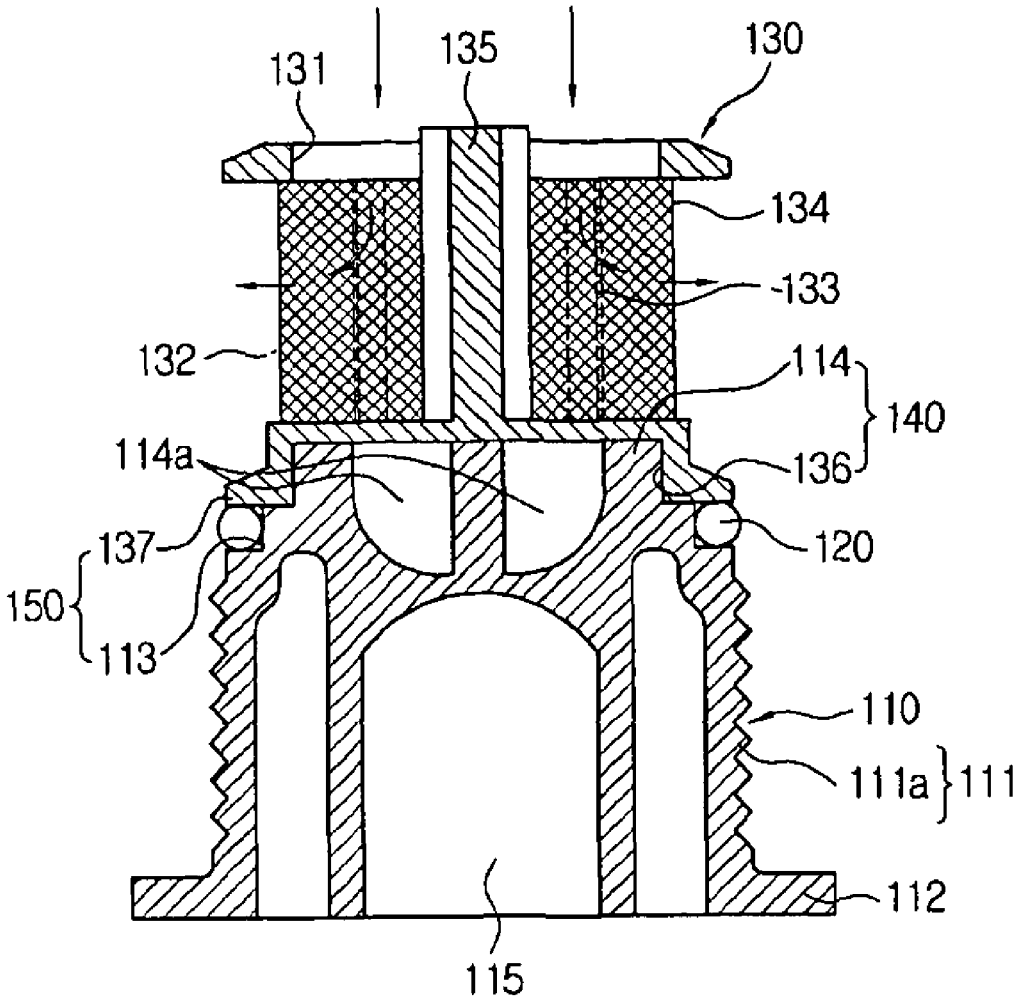

[Fig. 6]
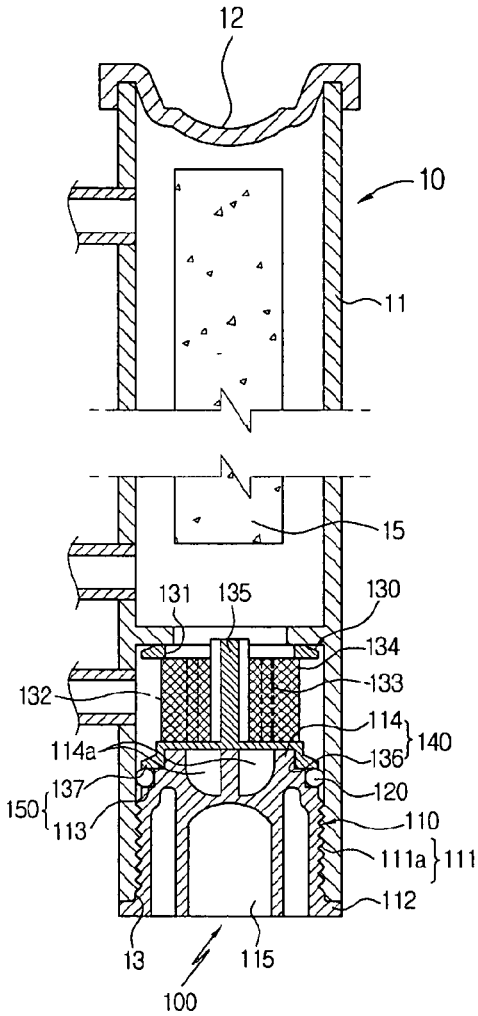
[Fig. 7]
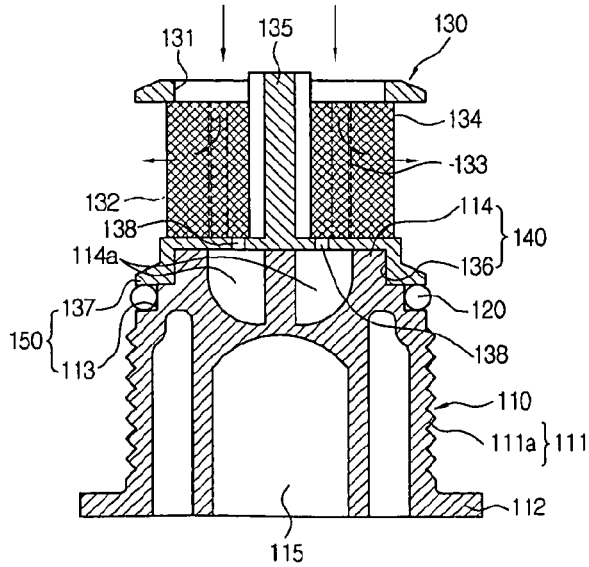

[Fig. 8]
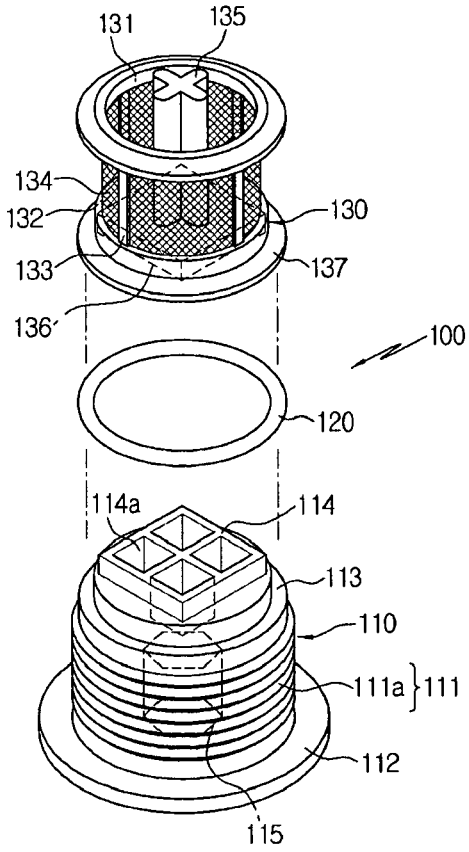
[Fig. 9]
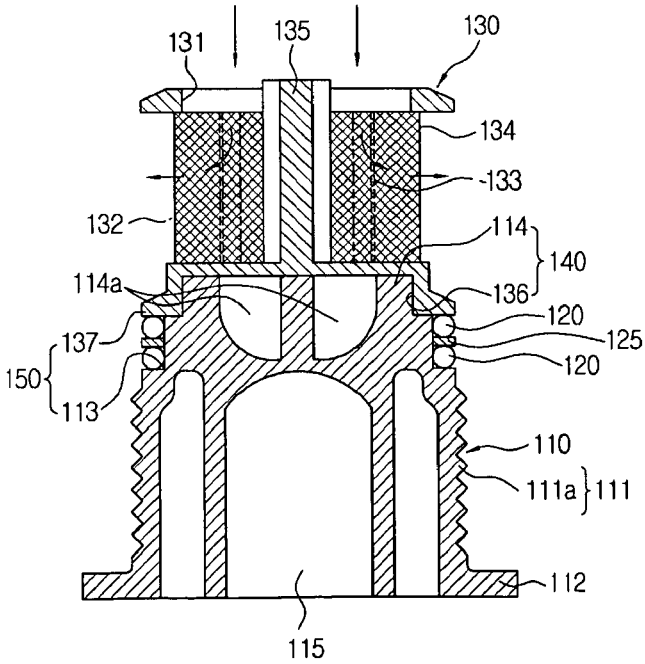

[Fig. 10]
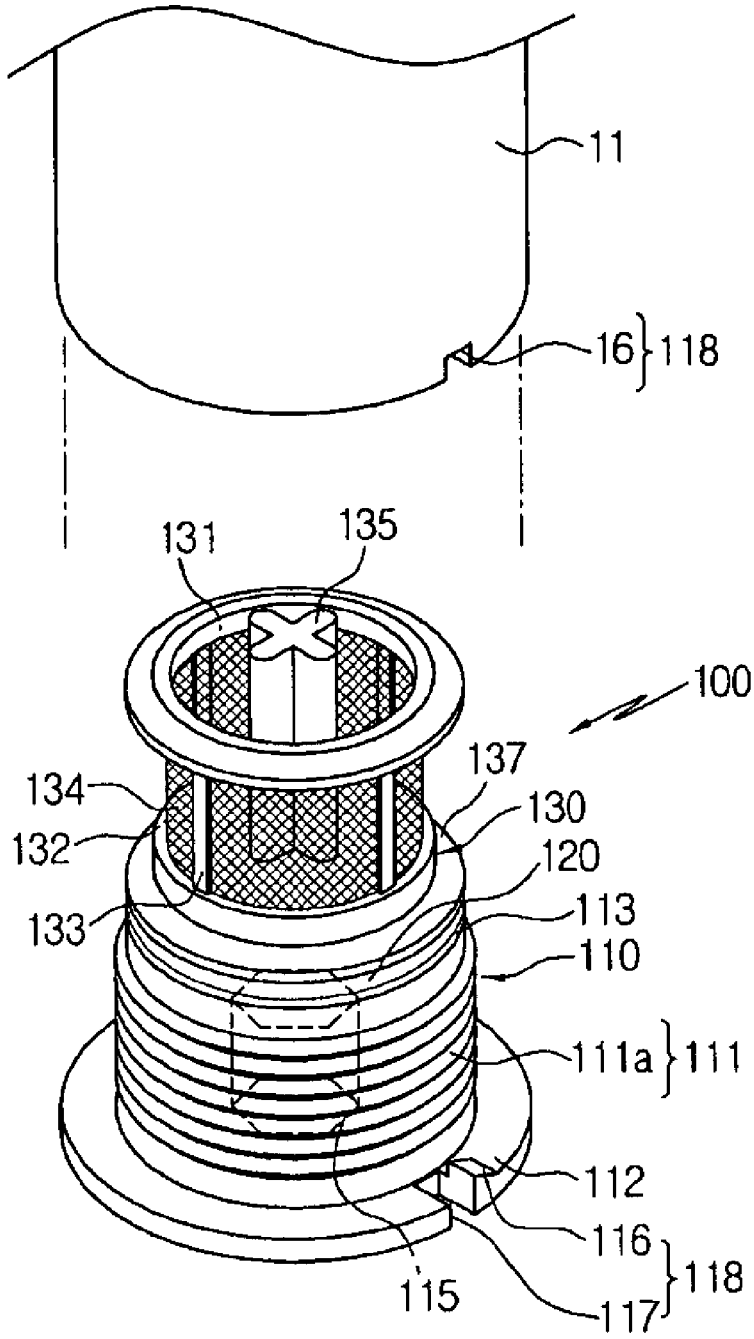

CAP FOR HERMETICALLY SEALING RECEIVER DRIERS

This application is a §371 of PCT/KR2005/002569 filed Aug. 8, 2005, which claims priority from Korean Patent Application No. 10-2004-0062860 filed Aug. 10, 2004, Korean Patent Application No. 10-2004-0112724 filed Dec. 27, 2004 and Korean Patent Application No. 10-2005-0067750 filed Jul. 26, 2005.

TECHNICAL FIELD

The present invention relates to a cap for hermetically sealing receiver driers, and more particularly, to a cap for hermetically sealing receiver driers, in which a cap body and a filter are separated and detachably engaged with each other and an O-ring is installed between the cap body and the filter, thereby facilitating the replacement of parts and the installation of the O-ring, favoring automatic assembly due to a tool insertion recess that can be formed long, achieving compactness of the cap due to the reduction of a total height of the cap when the cap body and the filter are engaged, improving a filtering effect by increasing the size of the filter with the cap being maintained in the same size, and preventing the cap body from being released from a tank.

BACKGROUND ART

In a cooling system for vehicles, a compressor compresses a working fluid that does heat exchange with the ambient air into a high-temperature, high-pressure gas and transfers the compressed working fluid to a condenser. The condenser changes the state of the working fluid in a gas state into a liquid state to increase the amount of heat absorption and transfers the working fluid in the liquid state to an expansion valve. The expansion valve expands the working fluid into a low-temperature, low-pressure state and transfers the expanded working fluid to an evaporator. The evaporator causes the low-temperature, low-pressure working fluid to do heat exchange (to absorb the ambient heat), thereby cooling a predetermined space.

DISCLOSURE OF INVENTION

Technical Problem

The working fluid circulating along the above-described path should be condensed into the liquid state by the condenser to absorb the ambient heat, but a portion of the working fluid remains in the gas state and passes through the condenser. As a result, the liquid state and the gas state coexist in the working fluid.

Thus, when the working fluid in which the gas state and the liquid state coexist does heat exchange in the evaporator, the working fluid in the gas state hardly absorbs the ambient heat, resulting in degradation of cooling efficiency.

Technical Solution

To solve such a problem, a receiver drier is installed between the condenser and the expansion valve. The receiver drier separates/removes the working fluid in the gas state, which was not changed to the liquid state in the condenser, or absorbs moisture contained in the circulating working fluid, thereby improving cooling efficiency.

As shown in FIG. 1, a receiver drier 10 is generally attached to a header tank 2 at a side of a condenser 1.

In the receiver drier 10, a desiccant 15 is contained in a tank 11 having a closed top and an opened bottom to remove the working fluid in the gas state and moisture and a cap 20 is assembled/fixed to and closes the bottom of the tank 11 to remove impurities contained in the working fluid passing through the desiccant 15.

As shown in FIG. 2, the cap 20 includes a body 30 and a filter 40 that are formed of metal in one body. In the body 30, a screw 31 is formed along the circumference of the body 30 to be screw-engaged in an opening 13 at a lower portion of the tank 11 and an O-ring 50 that keeps airtightness and a flange 32 attached to the bottom of the tank 11 are sequentially formed under the screw 31. Further, a tool insertion recess (not shown) is formed at a lower portion of the tank 11 for assembling.

The filter 40 is formed on the body 30 as one body. An inlet 41 is formed on the filter 40 to allow the inflow of the working fluid. A plurality of outlets 42 is formed at sidewalls of the filter 40 to allow the discharge of the working fluid. In addition, a filter net 43 is installed inside the filter 40 to remove impurities contained in the working fluid.

However, such a conventional cap 20 causes an increase in weight because of being formed of metal and increases manufacturing cost because of being formed of an expensive material and requiring complex manufacturing process.

Moreover, since the body 30 and the filter 40 are formed as one body, when one of them malfunctions, the entire part cannot function normally and thus should be replaced.

When the O-ring 50 is installed in a groove 51 formed along the circumference of the body 30, since the inside diameter of the O-ring 50 is smaller than the outside diameter of the body 30, the O-ring 50 is moved to and installed in the groove 51 while being expanded. As a result, the installation of the O-ring 50 is not easy and is difficult to automate.

Furthermore, when the cap 20 is manufactured compact, the filter 40 is also size-reduced, degrading a filtering effect. Consequently, many problems are posed in compactness of the cap 20.

Thus, the same applicant of the present invention discloses a structure formed by insert-injecting a metal filter in Korean Patent Laid-Open Publication No. 2001-065605 and a structure in which an injection-molded filter is settled and engaged with a metal cap in Korean Patent Laid-Open Publication No. 2003-086096.

In addition, Japanese Patent Laid-Open Publication No. 2000-292030 discloses a structure in which a filter and a cap body are separately molded and a convex portion and a groove portion formed on engagement faces of the filter and the cap body are engaged with each other.

However, a difficulty remains in the installation of an O-ring.

As shown in FIG. 3, it can be seen that the state of engagement between the tank 11 and the body 30 of the cap 20 changes with temperature such as low temperature (in winter), middle temperature (normal temperature), and high temperature (in operation). In other words, the cap 20 is released due to not only a heat shrinkage difference resulting from a change in temperature but also vibration and lack of tension of engagement.

In particular, in a middle-temperature (normal-temperature) state, when the screw 31 of the body 30 is not closely contacted to, but is separated from a screw of the tank 11, tension of engagement is lowered to the lowest level, accelerating the release of the cap 20.

ADVANTAGEOUS EFFECTS

It is, therefore, an object of the present invention to provide a cap for hermetically sealing receiver driers, in which a cap body and a filter are separated and detachably engaged with each other and an O-ring is installed between the cap body and the filter, thereby facilitating the replacement of parts and the installation of the O-ring, favoring automatic assembly due to a tool insertion recess that can be formed long, achieving compactness of the cap due to the reduction of a total height of the cap when the cap body and the filter are engaged, improving a filtering effect by increasing the size of the filter with the cap being maintained in the same size, and facilitating engagement between the cap body and the filter and preventing the cap body from being released from a tank by discharging the air between the cap body and the filter.

To achieve the above and other objects, there is provided a cap for hermetically sealing receiver driers. The cap includes a cap body, a filter, and an O-ring installation means. The cap body includes a coupling portion formed along its outer circumference to be engaged with an opening of a tank of a receiver drier and a flange formed at its lower end portion.

The filter includes an engagement means 140 that detachably couples the filter with the upper portion of the cap body 110, an inlet 131 and an outlet 132 to allow a working fluid passing therethrough, and a filter net 134 formed along its circumference. The an O-ring installation includes an O-ring seating portion 113 having one side opened along the circumference of an upper portion of the cap body 110 and an O-ring supporting portion 137 that is formed at lower end portion of the filter 130 and close an open side of the O-ring seating portion so as to prevent the O-ring from being separated.

The engagement means includes a protrusion at an upper portion of the cap body and an insertion groove corresponding to the protrusion in a lower portion of the filter.

BRIEF DESCRIPTION OF THE DRAWINGS

Further objects and advantages of the invention can be more fully understood from the following detailed description taken in conjunction with the accompanying drawings in which:

FIG. 1 is a cross-sectional view of a conventional condenser having integrated receiver drier;

FIG. 2 is a cross-sectional view illustrating a state where a cap is engaged in a conventional receiver drier;

FIG. 3 illustrates sections in which the state of engagement of a cap in a conventional receiver drier changes with temperature;

FIG. 4 is an exploded perspective view of a cap for hermetically sealing a receiver drier according to the present invention;

FIG. 5 is a cross-sectional view illustrating engagement cut along a line A-A shown in FIG. 4;

FIG. 6 is a cross-sectional view illustrating a state where a cap for hermetically sealing a receiver drier is engaged in the receiver drier according to the present invention;

FIG. 7 is a cross-sectional view illustrating a case where an air discharge hole is formed at a filter side in a cap for hermetically sealing a receiver drier according to the present invention;

FIG. 8 is an exploded perspective view illustrating a case where engaged portions of a cap body and a filter are formed in a non-circular shape in a cap for hermetically sealing a receiver drier according to the present invention;

FIG. 9 is a cross-sectional view illustrating engagement of a cap for hermetically sealing a receiver drier according to another embodiment of the present invention; and FIG. 10 is a perspective view of a cap for hermetically sealing a receiver drier according to still another embodiment of the present invention.

BEST MODE FOR CARRYING OUT THE INVENTION

Hereinafter, the present invention will be described in detail with reference to the accompanying drawings.

In the following description, like reference numerals will be designated for like components in the prior art and the present invention and a detailed description of the like components may not be repeated.

FIG. 4 is an exploded perspective view of a cap for hermetically sealing a receiver drier according to the present invention, FIG. 5 is a cross-sectional view illustrating engagement cut along a line A-A shown in FIG. 4, FIG. 6 is a cross-sectional view illustrating a state where a cap for hermetically sealing a receiver drier is engaged in the receiver drier according to the present invention, FIG. 7 is a cross-sectional view illustrating a case where an air discharge hole is formed at a filter side in a cap for hermetically sealing a receiver drier according to the present invention, and FIG. 8 is an exploded perspective view illustrating a case where engaged portions of a cap body and a filter are formed in a non-circular shape in a cap for hermetically sealing a receiver drier according to the present invention.

The receiver drier 10 according to the present invention includes the tank 11, the desiccant 15, and a cap 100. The tank 11 having a top closed by a top cap 12 and an opened bottom is installed to communicate with the header tank 2 of the condenser 1. The desiccant 15 is included inside the tank 11. The cap 100 is screw-engaged in the opening 13 and opens/closes the opening 13.

Here, the desiccant 15 removes the working fluid in the gas state, which was not changed into the liquid state in the condenser 1, or moisture, thereby improving cooling efficiency. Various filter members may be used, instead of the desiccant 15.

The cap 100 according to the present invention includes a cap body 110 and a filter 130 that are separated from each other. The cap 100 is injection-molded using synthetic resin, more preferably, an engineering plastic (EP) material securing mechanical strength such as nylon or acryl.

A coupling portion 111 is formed along the circumference of the cap body 110 to allow the cap body 110 to be engaged in the opening 13 of the tank 11 of the receiver drier 100. A flange 112 is protruded at the bottom of the cap body 110 to contact the bottom of the receiver drier 10.

Here, the coupling portion 1 includes a screw portion 111*a* along the circumference of the cap body 110 to screw-engage the cap body 110 with the opening 13 of the tank 11.

Further, a tool insertion recess 115 is formed in a center portion under the cap body 110 to facilitate assembling using an engagement tool when the cap body 110 is assembled to the receiver drier 10.

It is preferable that the tool insertion recess 115 be formed long in the longitudinal direction of the cap body 110 inside the cap body 110 to be more useful for automatic assembly. In other words, the contact area between the engagement tool and the cap body 110 increases and thus vibration during assembling is reduced, thereby facilitating assembling.

The filter 130 is detachably engaged with the cap body 110 by means of an engagement means 140. An inlet 131 is formed on the filter 130 to allow the inflow of the working fluid. A plurality of outlets 132 is formed along the circumference of the filter 130 by a plurality of support bars 133 formed at predetermined intervals to allow the discharge of the working fluid flowing in through the inlet 131.

A filter net 134 is formed along the circumference of the filter 130 to remove impurities contained in the working fluid passing through the outlets 132.

It is preferable that the filter net 134 be injection-molded as one body with the filter 130 in injection molding of the filter 130, but the filter net 134 may be a separate metal net and the filter net 134 and the filter 130 may be double injection-molded.

A support portion 135 is formed inside the filter 130 to support the desiccant 15 of the receiver drier 10. Here, it is preferable that a tip end of the support portion 135 be more protruded than the top of the filter 130.

In other words, if the desiccant 15 is introduced into the filter 130 by gravity, it prevents the inflow of the working fluid. The support portion 135 supports the desiccant 15, thereby solving such a problem.

The engagement means 140 includes a protrusion 114 stepwisely formed at an upper end portion of the cap body 110 and an insertion groove 136 formed at a lower end portion of the filter 130 to correspond to the protrusion 114.

Since the protrusion 114 of the cap body 110 is detachably inserted into or engaged with the insertion groove 136 of the filter 130, when one of the cap body 110 and the filter 130 malfunctions, only a corresponding part needs to be replaced, thereby facilitating the replacement and reducing manufacturing cost.

Here, the protrusion 114 is formed stepwise with respect to an O-ring seating portion 113 that will be described below.

A plurality of grooves 114*a* is formed at the inner side of the protrusion 114 to reduce weight and using material.

A discharge hole 138 is formed in the filter 130 to discharge the air in the insertion groove 136 for smooth engagement between the protrusion 114 and the insertion groove 136.

In other words, to engage the cap body 110 and the filter 130, the protrusion 114 of the cap body 110 and the insertion groove 136 of the filter 130 are engaged. At this time, the air remaining in the insertion groove 136, which interferes engagement when the protrusion 114 is inserted into the insertion groove 136, is discharged through the discharge hole 138 and thus facilitates smooth engagement.

Furthermore, it is preferable that the protrusion 114 of the cap body 110 and the insertion groove 136 of the filter 130 are formed in a non-circular shape such as polygonal or elliptical so as to prevent them from running idle after engagement.

Here, when the protrusion 114 of the cap body 110 and the insertion groove 136 of the filter 130 are formed circular, it is preferable that they be engaged by forced insertion or tap-engaged. The cap body 110 and the filter 130 may be engaged by thermal welding or ultrasonic welding. In this case, protrusion 114 of the cap body 110 and the insertion groove 136 of the filter 130 may be eliminated.

Due to the above-described structure in which the protrusion 114 of the cap body 110 is inserted into the insertion groove 136 of the filter 130, the tool insertion recess 115 can be formed longer under the cap body 110, favoring automatic assembly.

An O-ring installation means 150 is installed between the cap body 110 and the filter 130 to install an O-ring 120 for keeping airtightness between the receiver drier 10 and the cap 100.

The O-ring installation means 150 includes the O-ring seating portion 113 having one side opened along the circumference of an upper portion of the cap body 110 and an O-ring supporting portion 137 under the filter 130. The O-ring supporting portion 137 is formed protruded to support the O-ring 120 settled in the O-ring seating portion 113 and closes an opened portion of the O-ring seating portion 113 to prevent the O-ring 120 from being separated.

Here, since the O-ring seating portion 113 is opened in the axis direction and has an inner diameter that is similar to the O-ring 120, it is easy to insert/install the O-ring 120 in the O-ring seating portion 113, favoring automation. After the O-ring 120 is settled in the O-ring seating portion 113, the filter 130 is engaged and thus an O-ring supporting portion 137 of the filter 130 supports the O-ring 120, thereby preventing the O-ring 120 from being separated.

Therefore, when the cap body 110 and the filter 130 are engaged, the total height of the cap 100 can be reduced, thereby forming the compact cap 100.

In other words, according to prior art, the groove 51 is formed to a predetermined depth so as for the O-ring 50 to be settled in the body 30. At this time, the upper and lower portions of the groove 51 should be blocked to prevent the O-ring 50 from being separate. As a result, the height of the body 30 is increased, causing an increase in the total height of the cap 20.

Moreover, according to prior art, when the groove 51 in which the O-ring 50 is to be settled is injection-molded, there is a high possibility that a burr is generated at an injection boundary. In other words, to form the annular groove 51 in the body 30 of the cap 20, a pair of injection molding flames separated at both sides is required and a burr is generated at the boundary between the injection molding frames.

As such, when a burr is generated in the groove 51 in which the O-ring 50 is settled, there is a high possibility that refrigerant may leak between the O-ring 50 and the body 30 of the cap 20.

However, according to the present invention, the upper portion of the O-ring seating portion 113 is opened, and thus the opened portion reduces the height of the cap body 110. In addition, the O-ring supporting portion 137 closes the opened portion of the O-ring seating portion 113 when the filter 130 is engaged with the O-ring 120, thereby preventing the O-ring 120 from being separated and reducing the total height of the cap 100.

When the cap 100 is maintained in the same size, the cap body 110 can be reduced as mentioned above, thereby increasing the size of the filter 130 and thus improving a filtering effect.

Furthermore, when the cap body 110 is injection-molded, a burr is prevented from being generated in the O-ring seating portion 113, thereby reducing a risk of the leakage of refrigerant.

As described above, the cap 100 for hermetically sealing the receiver drier 10 according to the present invention separately injection-molds the cap body 110 and the filter 130, inserts/installs the O-ring 120 in the O-ring seating portion 113 formed at an upper portion of the cap body 110, and engages the filter 130 with the cap body 110, thereby completing assembling of the cap 100.

The assembled cap 100 is screw-engaged in the opening 13 at a lower portion of the tank 11, thereby closing the opening 13.

FIG. 9 is a cross-sectional view illustrating engagement of a cap for hermetically sealing a receiver drier according to another embodiment of the present invention. In case that one O-ring 120 is installed in the O-ring seating portion 113 like the above embodiment of the present invention, supplying condition of cooling lubricant may become worse. To solve such a problem, in another embodiment of the present invention, a plurality of O-rings 120 (two O-rings in FIG. 9) is installed in the O-ring seating portion 113 and a liner 125 in the shape of a plate is installed between the O-rings 120 to stably and closely support the O-rings 120 and improve sealing performance.

FIG. 10 is a perspective view of a cap for hermetically sealing a receiver drier according to still another embodiment of the present invention. When the cap body 110 is engaged in the tank 11 of the receiver drier 10, engagement strength becomes weak due to a heat shrinkage difference due to a change in temperature, vibration, or lack of tension of engagement, and thus the cap body 110 may be released. As a result, in the present invention, a release prevention means 118 is installed between the bottom portion of the tank 11 and the flange of the cap body 110 to prevent the cap body 110 from being released after engagement.

The release prevention means 118 includes a locking groove 16 formed at a bottom portion of the tank 11 and a locking protrusion 116 formed on the top surface of the flange 112 to be locked in the locking groove 16.

A cut groove 117 is formed on the flange 112 at a side of the locking protrusion 116, so that the locking protrusion 116 can be easily locked in the locking groove 16 through its elastic operation.

As described above, in the present invention, to screw-engage the cap body 110 with the opening 13 of the tank 11 of the receiver drier 10, the screw portion 111*a* is formed along the circumference of the cap body 110. However, the cap body 110 may be engaged in the opening 13 of the tank 11 using snap-ring tool or pins without being limited to the above-described engagement.

INDUSTRIAL APPLICABILITY

As described above, according to the present invention, a cap body and a filter are separately injection-molded and detachably engaged with each other and an O-ring is installed between the cap body and the filter. Thus, when one of the cap body and the filter malfunctions and the entire part cannot function normally and thus should be replaced, only a corresponding part needs to be replaced, thereby facilitating the replacement and reducing manufacturing cost. In addition, since a tool insertion recess can be formed long, the present invention is more useful for automatic assembly.

Moreover, compactness of the cap can be achieved due to the reduction of a total height of the cap when the cap body and the filter are engaged. A filtering effect is improved by increasing the size of the filter with the cap being maintained in the same size.

Furthermore, the filter includes a discharge hole to discharge the air in the insertion recess for smooth engagement between the protrusion and the insertion recess.

In addition, a plurality of O-rings is installed in an O-ring seating portion and a liner is installed between the O-rings, thereby improving lubricant supply conditions.

Since a locking groove and a locking protrusion are formed at a lower portion of the tank and in a flange of the cap body, it is possible to prevent the cap body from being released after engagement.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A cap for hermetically sealing a receiver drier, the cap comprising:

a cap body which includes a coupling portion formed along its outer circumference to be engaged with an opening of a tank of a receiver drier and a flange formed at its lower end portion;

a filter including an engagement means that detachably couples the filter with the upper portion of the cap body, an inlet and an outlet to allow a working fluid passing therethrough, and a filter net formed along its circumference; and an O-ring installation means which includes an O-ring seating portion having one side opened along the circumference of an upper portion of the cap body and an O-ring supporting portion that is formed at lower end portion of the filter and closes the opened side of the O-ring seating portion so as to prevent the O-ring from being separated wherein the engagement means includes a protrusion formed at an upper end portion of the cap body and an insertion groove formed at a lower end portion of the filter to correspond to the protrusion, wherein the protrusion further includes a material reducing groove to reduce the amount of material, and wherein the lower end portion of the filter includes a discharge hole that communicates with the material reducing groove.

2. The cap of claim 1, wherein the protrusion and the insertion groove are formed in a non-circular shape to prevent them from running idle after engagement.

3. The cap of claim 1, wherein a support portion is formed inside the filter to support a desiccant contained in the receiver drier.

4. The cap of claim 1, wherein the cap body has a tool insertion recess formed inside the lower portion thereof to assemble the cap body.

5. The cap of claim 1, wherein a plurality of O-rings are installed at the O-ring seating portion and a liner is installed between the O-rings to closely support the O-rings.

6. The cap of claim 1, wherein a release prevention means is installed between the bottom portion of the tank and the flange of the cap body so as to prevent the cap body from being released after engagement.

7. The cap of claim 6, wherein the release prevention means includes a locking groove formed at a bottom portion of the tank and a locking protrusion formed on the top surface of the flange to be locked in the locking groove.

8. The cap of claim 7, wherein a cut groove is formed on at one side of the locking protrusion of the flange for causing an elastic operation of the locking protrusion.

9. The cap of claim 1, wherein protrusion and the insertion groove are tap-engaged.

* * * * *